US007021583B2

(12) United States Patent
Weatherill et al.

(10) Patent No.: US 7,021,583 B2
(45) Date of Patent: Apr. 4, 2006

(54) REEL HOUSING WITH DECORATIVE ACCESS PANEL

(75) Inventors: Sean B. Weatherill, Castro Valley, CA (US); James B.A. Tracey, Danville, CA (US)

(73) Assignee: Great Stuff, Inc., Austin, TX (US)

( * ) Notice: Subject to any disclaimer, the term of this patent is extended or adjusted under 35 U.S.C. 154(b) by 537 days.

(21) Appl. No.: 09/777,420

(22) Filed: Feb. 6, 2001

(65) Prior Publication Data

US 2002/0104916 A1 Aug. 8, 2002

(51) Int. Cl.
*B65H 75/44* (2006.01)

(52) U.S. Cl. ..... 242/398; 242/397; 242/403; D8/358; 137/355.26; 137/355.27

(58) Field of Classification Search ..... 242/403, 242/397, 398; D8/358; 137/355.27, 355.16, 137/355.26
See application file for complete search history.

(56) References Cited

U.S. PATENT DOCUMENTS

| | | | | |
|---|---|---|---|---|
| 2,286,904 | A * | 6/1942 | Ewald | 137/355.26 |
| 2,403,277 | A * | 7/1946 | Hall | 137/355.26 |
| 2,540,434 | A | 2/1951 | Fengler | |
| 3,101,846 | A | 8/1963 | Eifrid | |
| 3,493,105 | A | 2/1970 | Greb et al. | |
| 4,223,710 | A | 9/1980 | Brothers | |
| 4,330,005 | A | 5/1982 | Kjarsgaard | |
| 4,969,610 | A | 11/1990 | Taylor et al. | |
| D328,183 | S | 7/1992 | Harris | |
| D340,576 | S | 10/1993 | Delagarza et al. | |
| 5,390,695 | A | 2/1995 | Howard | |
| 5,566,898 | A | 10/1996 | Cline | |
| 5,634,615 | A | 6/1997 | Shuen | 248/89 |
| D382,327 | S | 8/1997 | Young et al. | |
| 5,988,207 | A * | 11/1999 | Kownacki et al. | 137/355.27 |
| D419,961 | S * | 2/2000 | Weatherill | D13/154 |
| 6,279,848 | B1 * | 8/2001 | Mead, Jr. | 242/397.3 |

* cited by examiner

*Primary Examiner*—John Q. Nguyen
(74) *Attorney, Agent, or Firm*—Knobbe Martens Olson & Bear

(57) ABSTRACT

A reel housing enclosing a reel assembly includes an access panel, wherein opening or removal of the access panel allows access to the interior of the housing. The exterior surface of the access panel is decorated with facial indicia so that the access panel resembles the face of an animal or character. The exterior surface of the housing has a color design to visually enhance the depiction of the animal or character.

26 Claims, 5 Drawing Sheets

REEL HOUSING WITH DECORATIVE ACCESS PANEL

BACKGROUND

1. Field of the Invention

The present invention relates generally to reels for spooling linear material, and more particularly to reel housings for garden hoses or electrical cables.

2. Description of the Related Art

In the past, reels have been used for spooling linear material, such as hoses or wires. Many of such reels comprise a rotating reel drum enclosed within a housing during operation. A variety of different types of housings have been used. For example, reel housings have had many different shapes, such as cylindrical, rectangular, octagonal, etc. Generally, there has been very little effort expended in improving the aesthetic appearance of reel housings, especially those of garden hose and cable reels.

SUMMARY

Accordingly, it is a principle object and advantage of the present invention to provide a reel housing having an improved, aesthetically pleasing appearance. Another object is to provide a reel housing whose external appearance is particularly and thematically suited for an outdoor garden.

In accordance with one aspect, the present invention provides a reel housing configured to enclose a rotatable reel drum. The interior of the housing can be accessed by removing or opening an access panel. Accordingly, in one embodiment the access panel is entirely removable. In another embodiment the access panel is hingedly connected to the remainder of the housing body so that it can be opened. The exterior surface of the access panel has facial indicia resembling the face of an animal or character, such as an insect, human, cartoon character, alien or other fantastic creature. In one embodiment, the facial indicia include one or more of (i) a pair of eyes, (ii) a nose or beak, and (iii) a mouth.

In accordance with another aspect, the present invention provides a reel housing comprising a housing body configured to enclose a rotatable reel drum. The housing body has an access panel which can be opened or removed to allow access to an interior of the housing body. The exterior surface of the access panel is decorated with three dimensional facial indicia including one or more of (i) a pair of eyes, (ii) a nose or beak, and (iii) a mouth.

In accordance with yet another aspect, the present invention provides a reel housing configured to enclose a rotatable reel drum. The housing has an access panel having an exterior surface. The access panel has a first position in which the access panel does not permit a human hand to access the interior of the housing, and a second position in which the access panel permits a human hand to access the interior of the housing. The exterior surface of the access panel has facial indicia resembling an animal or character, such as an insect, a human, or a fantastic creature.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1:
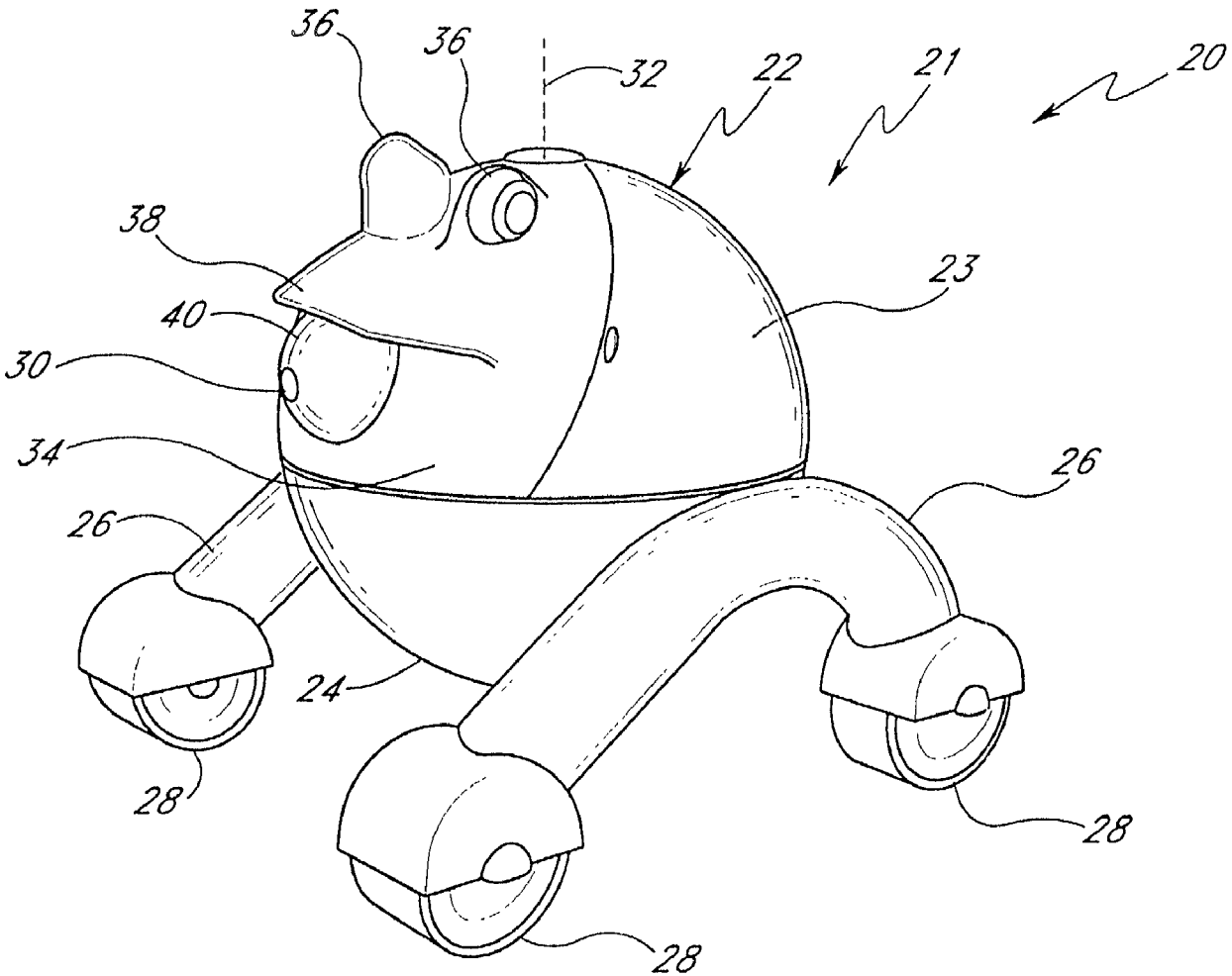
FIG. 1 is a perspective view of one embodiment of a reel according to the present invention, the reel having a housing configured to have the appearance of a frog.
Figure 2:
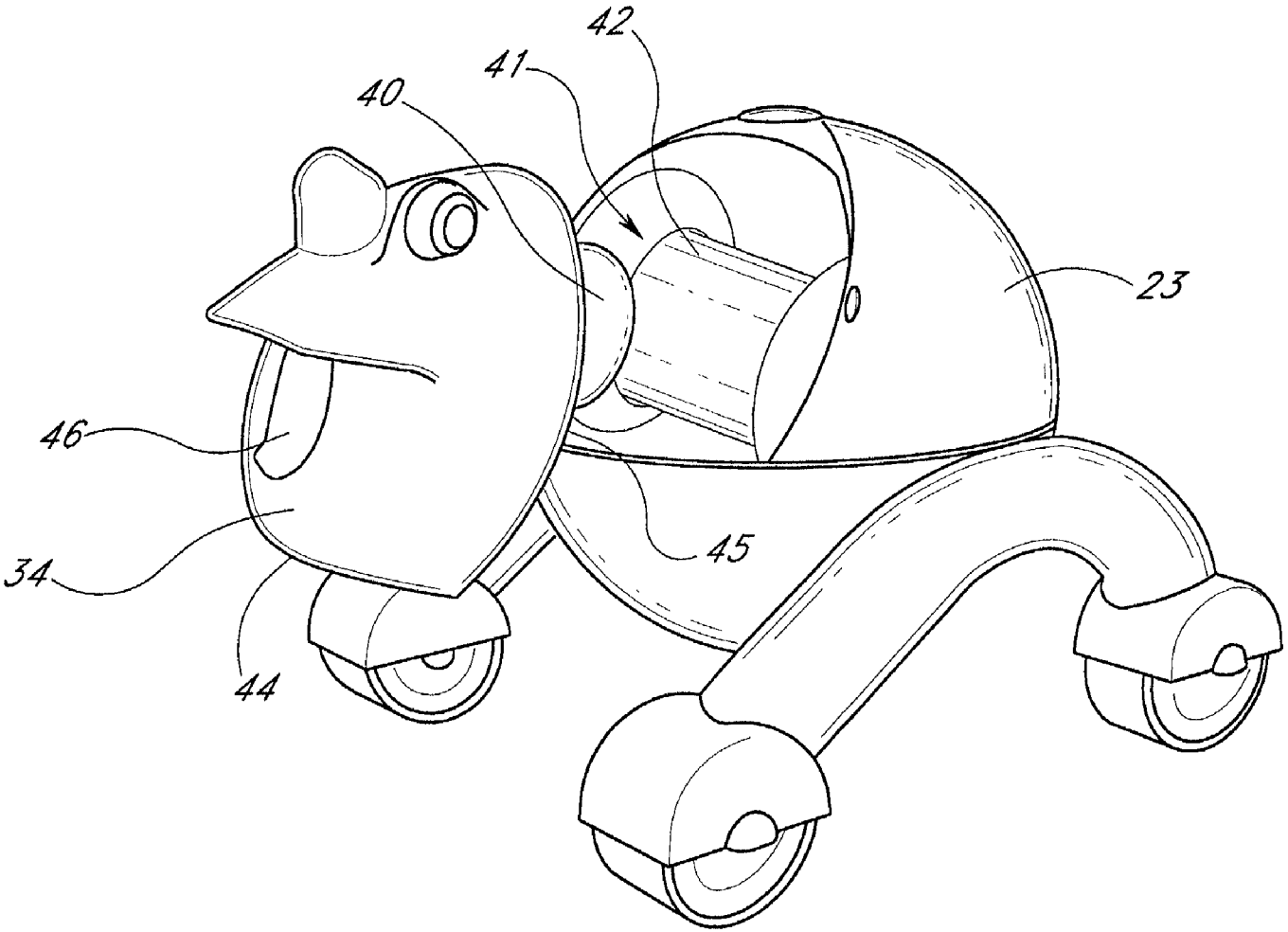
FIG. 2 is a perspective view of the reel of FIG. 1, illustrating the removability of an access panel of the reel housing.

FIGS. 1 and 2 show one embodiment of a reel having a housing configured according to the teachings of the present invention. Shown is a reel 20 comprising a reel housing 21 enclosing a reel assembly 41 (FIG. 2). The reel assembly includes a rotatable reel drum 42. In the illustrated embodiment, the housing 21 is generally spherical and comprises an upper hemisphere 22 and a lower hemisphere 24. The lower hemisphere 24 can have legs 26 with attached wheels 28, as shown. Preferably, the wheels 28 are designed for use in a yard or garden. Provided in the upper hemisphere 22 is a guide piece 40 including a guide aperture 30 configured to guide linear material, such as hose or wire, onto the reel drum 42. Preferably, the guide aperture 30 is particularly suited for guiding a length of garden hose and/or electrical cable onto the reel drum 42.

Preferably, the hemispheres 22 and 24 are configured to rotate relative to one another about a central vertical axis 32. There is preferably provided an electrical or manual reciprocating mechanism which converts the rotation of the reel drum 42 into reciprocating back and forth rotation of the upper hemisphere 22 relative to the lower hemisphere 24, about the axis 32. This causes the guide aperture 30 to reciprocatingly translate across the rotating drum surface. Such a reciprocating mechanism is disclosed in commonly owned U.S. Patent No. 6,279,848, entitled "Reel Having an Improved Reciprocating Mechanism," which is hereby incorporated herein by reference in its entirety. Advantageously, the reciprocal motion of the guide aperture 30 causes the linear material to be spooled substantially uniformly onto the drum 42. The skilled artisan will readily appreciate that a number of other reciprocating mechanisms can be employed to distribute linear material across the drum as it winds or unwinds.

The upper hemisphere 22 comprises a rear portion 23 and a facial indicia element, such as a decorative access panel 34 in the illustrated embodiment. The panel 34 is preferably configured to be readily removed or opened to allow access to the interior of the housing 21. Removal of the panel 34 thus allows a user to access the reel assembly 41. Alternatively, the panel 34 can be hingedly attached to the rear portion 23 so that the panel 34 can be opened to allow access to the reel assembly. In the illustrated embodiment, the panel 34 has a lower edge 44, which forms a portion of the length of the lower edge of the upper hemisphere 22, and an upper edge 45, which in the illustrated embodiment extends in an arc from the lower edge generally upward to a point at or near the top of the upper hemisphere 22.

The access panel 34 is preferably sized so that removal or opening of the panel 34 allows a user to place one or both of his or her hands inside the spherical reel housing 21. The length of the lower edge 44 of panel 34 comprises preferably at least 20%, more preferably about 30%±5%, and even more preferably up to 50% of the length of the lower edge of the upper hemisphere 22. Further, the housing 21 is preferably large enough so that there is enough room inside for the user to adjust or manipulate the interior assembly as necessary or desired. Preferably, the housing 21 has a diameter of at least 10 inches, more preferably between about 10–30 inches, and even more preferably 15–25 inches.

The outer surface of the panel 34 is decorated with facial indicia, which preferably include one or more of (i) a pair of eyes, (ii) a nose or beak, and (iii) a mouth. For example, the panel 34 shown in FIGS. 1 and 2 has facial indicia that include a pair of eyes 36, a nose 38, and a mouth formed by guide piece 40. The facial indicia preferably resemble the face of an animal or character (e.g., an insect, human, cartoon character, alien or other fantastic creature). In the illustrated embodiment, the facial indicia resemble a frog's face. The facial indicia preferably include three-dimensional relief, comprising elements which protrude outwardly from the exterior surface of panel 34. In the illustrated embodiment, "three-dimensional" means that the facial indicia deviate from the generally spherical surface of the reel housing 21. For example, the eyes 36, nose 38, and mouth of the panel 34 shown in FIGS. 1 and 2 are outwardly protruding elements. In other arrangements, the facial indicia can comprise indentations in the exterior surface of the panel 34. The exterior surface of the housing 21, comprising the upper and lower hemispheres 22 and 24, is preferably also colored to match the appearance of the animal or character depicted. For example, the housing 21 shown in FIGS. 1 and 2 is preferably colored green with some spots to more closely resemble the appearance of a frog.

The guide piece 40, which includes the guide aperture 30, is preferably formed separately from the panel 34. In the illustrated embodiment, the guide piece 40 fits within an orifice 46 in panel 34, shown clearly in FIG. 2. In some arrangements, the guide piece 40 is built integrally with the panel 34. In other arrangements, the guide piece is a separate piece that pivots like an ankle joint with respect to the panel 34, so that the guide aperture 30 "follows" the direction that the linear material is pulled toward. In one such arrangement, the orifice 46 is provided with inner rollers that allow the guide piece 40 to pivot like an ankle joint with respect to the panel 40.

The guide piece 40 preferably includes a friction-reducing element therein, which permits the linear material to be more easily pulled through the guide aperture 30. In one embodiment, the friction-reducing element comprises an assembly of rollers that roll against the linear material as it slides through the aperture 30, such as, for example, the roller assembly shown in the above-identified "Hose Reel Reciprocating Mechanism" patent application.

The access panel 34 is preferably configured to be interlockingly and non-movably engaged with the rear portion 23 of the upper hemisphere 22, preferably by a conventional latching mechanism or a friction fit. Those skilled in the art will understand that any of a variety of connection methods may be used, including snap-on engagements, nut and bolt combinations, etc. Desirably, the connection method includes a quick-release mechanism for easy and convenient removal or opening of the access panel 34. The access panel 34 can also be configured so that its lower edge 44 can engage the upper edge of the lower hemisphere 24. In a preferred embodiment, the panel 34 is rotatable with respect to the lower hemisphere 24 about the axis 32, preferably as described in the above-identified "Hose Reel Reciprocating Mechanism" patent application. When engaged together, the rear portion 23, the panel 34, and the lower hemisphere 24 form a generally spherical shape.

The housing 21, comprising the lower hemisphere 24, the rear portion 23, and the access panel 34, can be formed from a variety of materials, such as plastic, metal, composites, etc., giving due consideration to the goals of durability, long outdoor life, ease of manufacturing, and reduced expense. In the illustrated embodiment, the elements of the housing 21 are preferably molded plastic. The legs 26 are preferably formed from plastic, and are attached to the lower hemisphere 24 by any suitable manner. The wheels 28 are preferably formed from plastic, and are preferably at least 3 inches in diameter.

Figure 3:
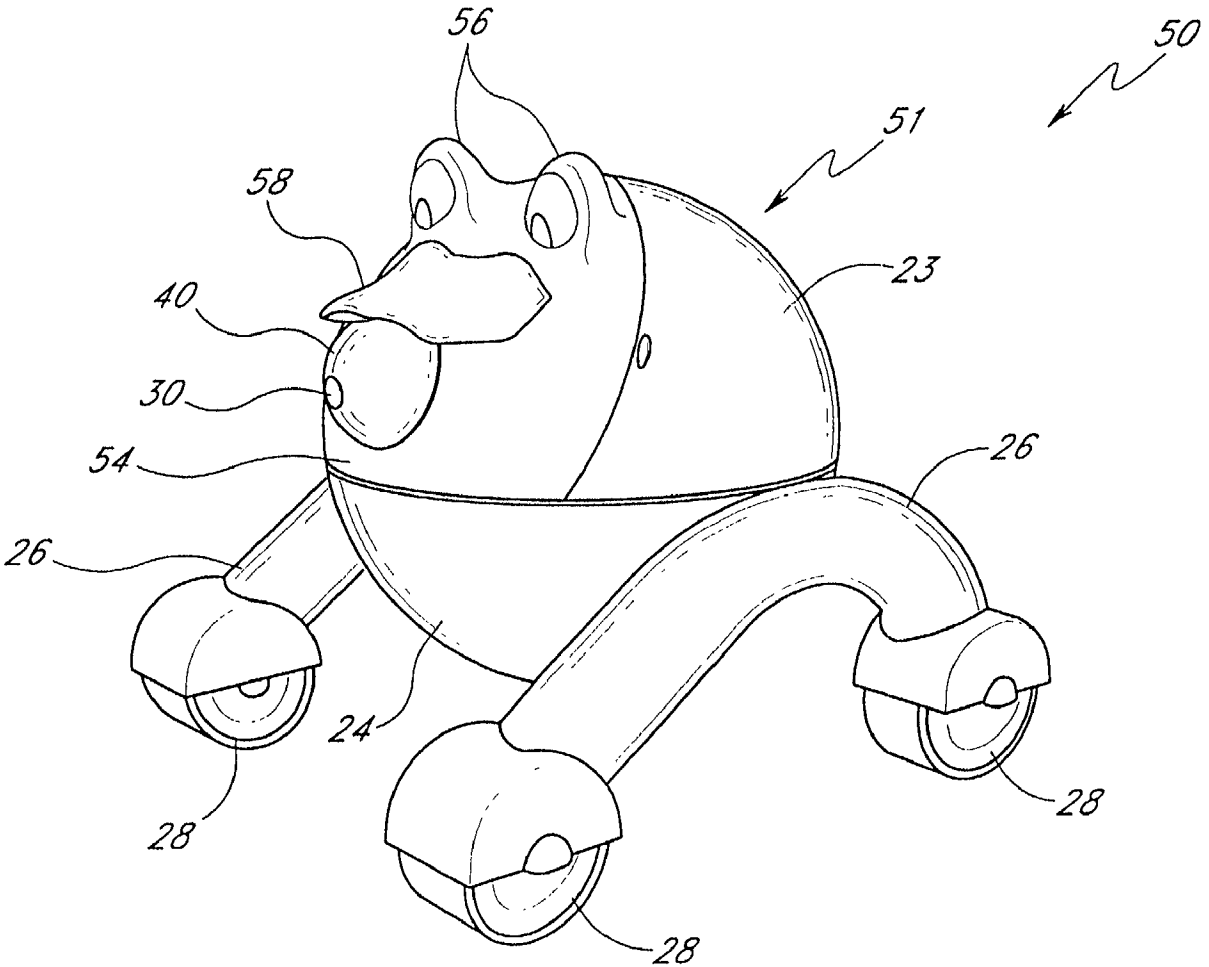
FIG. 3 is a perspective view of another embodiment of a reel according to the present invention, the reel having a housing configured to have the appearance of a duck.
Figure 4:
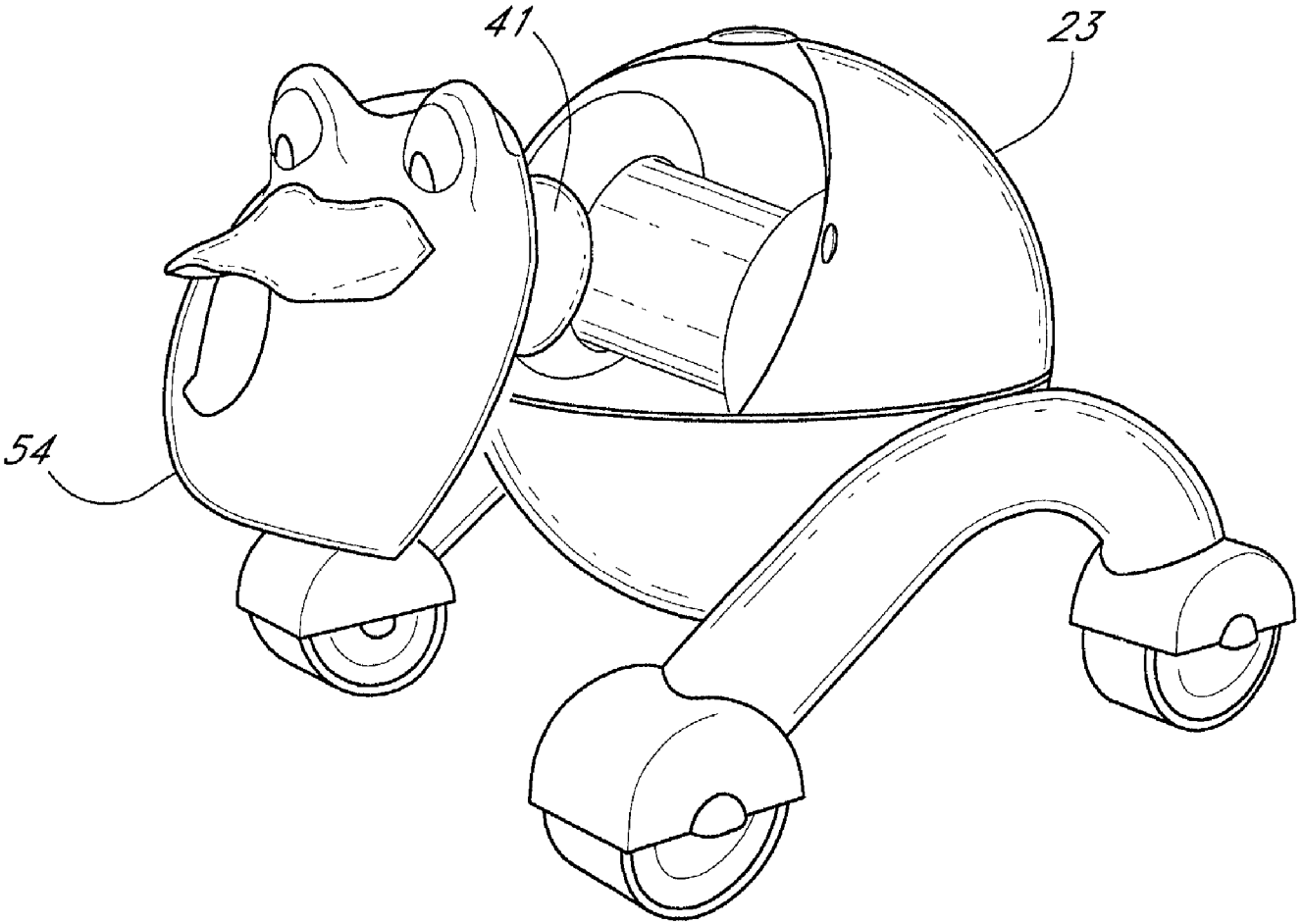
FIG. 4 is a perspective view of the reel of FIG. 3, illustrating the removability of an access panel of the reel housing.

FIGS. 3 and 4 show another embodiment of a reel housing having features according to the present invention. The illustrated embodiment is a reel 50 having a housing 51 that is identical in every aspect to the reel housing 21 shown in FIGS. 1 and 2, with the exception that it is decorated differently. In particular, the housing 51 includes an access panel 54 in place of the access panel 34 from the previous embodiment. The illustrated panel 54 has different facial indicia than the panel 34 of FIGS. 1 and 2. The illustrated panel 54, which includes a pair of eyes 56 and a beak 58, is configured to resemble a duck's face. Also, the exterior surface of the housing 51 can have a different color design, to match the appearance of a duck. For example, the housing 51 is preferably colored yellow. Apart from these differences in the panel, the housing 51 is preferably otherwise identical to the housing 21 of FIGS. 1 and 2. Both have identical rear portions 23, lower hemispheres 24, legs 26, and wheels 28. The only differences are those decorative aspects mentioned above.

Figure 5:
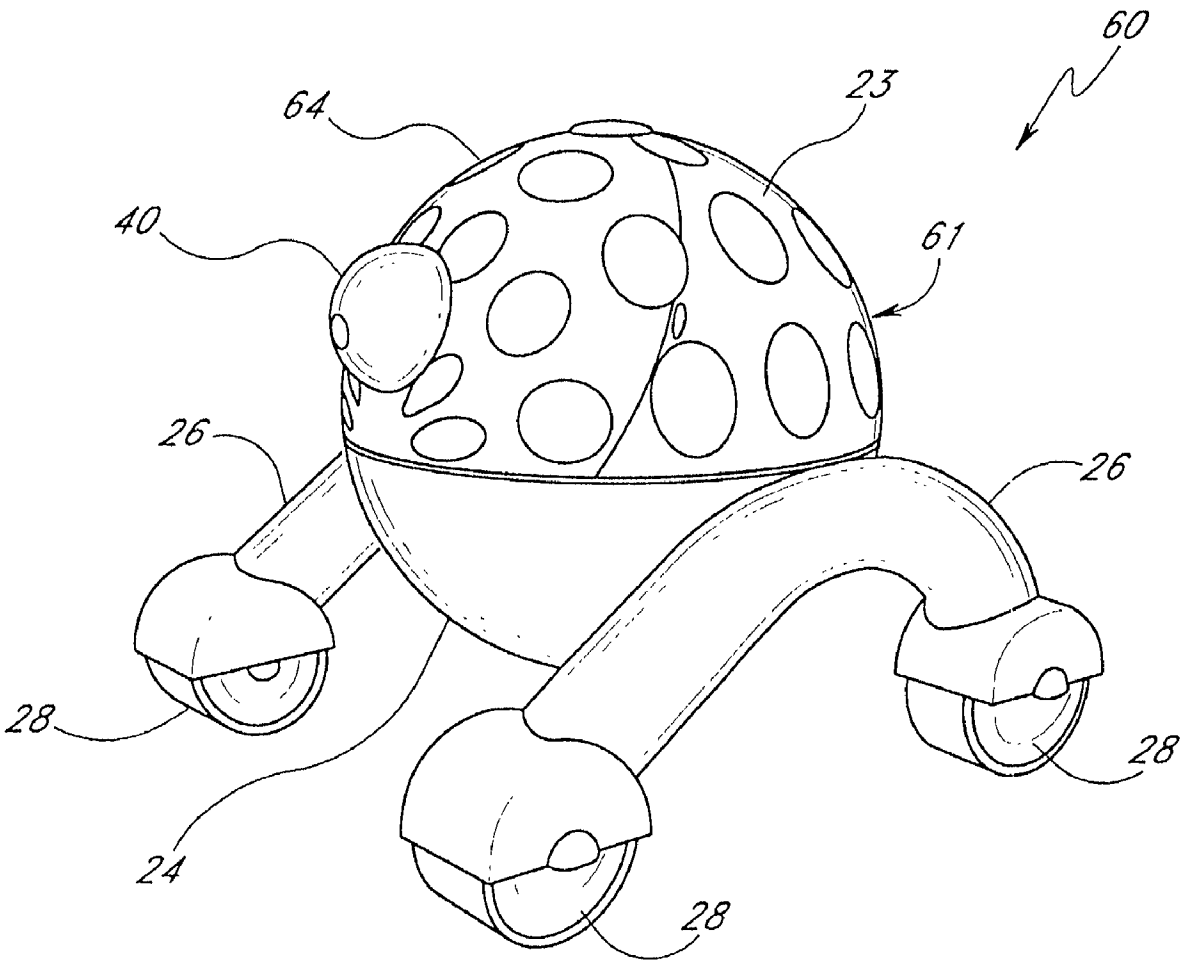
FIG. 5 is a perspective view of another embodiment of a reel according to the present invention, the reel having a housing configured to have the appearance of a lady bug.

FIG. 5 shows yet another embodiment of a reel having features according to the present invention. FIG. 5 shows a reel 60 having a housing 61 including an access panel 64. Again, the only differences between the illustrated reel housing 61 of FIG. 5 and the illustrated reel housings 21 and 51 of FIGS. 1 and 3, respectively, are that the panel 64 has different facial indicia and that the exterior surface of housing 61 has a different color design. In particular, the illustrated panel 64 has only a single facial feature formed by the guide piece 40, and the exterior surface of the housing 61 is colored red with black spots to resemble a ladybug.

Those skilled in the art will appreciate that any of a large variety of different animals or characters may be depicted by the reel housing without departing from the spirit and scope of the present invention. Various different facial indicia can be provided on the access panel of the reel housing, and the exterior surface of the housing can have many different color designs. The housing preferably depicts one of an animal, a human, a human-like character, and a fantastic or alien creature. It may depict a fictional or non-fictional character.

Preferably, the reel housing depicts an animal or character associated with the outdoors, such as the illustrated aquatic animals and insects. As a result, the reel is more aesthetically suited for outdoor placement, such as in a yard or garden.

The reel housings of the present invention may be provided in various different sizes, to accommodate differently sized reel assemblies. Advantageously, the reel housing embodiments described above are structurally similar, simplifying the manufacturing process. For one size of the reel housing, it is not necessary to manufacture different types of rear portions 23 and lower hemispheres 24. In fact, the only elements that have varying structural configurations between the various embodiments are the access panels 34, 54, and 64. For a single reel housing size, the various different panels may be sized and configured to engage a single size and configuration of the rear portion 23 and the lower hemisphere 24. This greatly reduces the costs associated with manufacturing the housing. Also, different access panels are advantageously interchangeable between different reel housings, if desired.

After an access panel is chosen for a particular housing, the exterior surface of the housing, including the panel, can then be colored. Alternatively, the housing can be formed from a colored material. For example, the illustrated reel 20 (FIGS. 1 and 2), which is configured to have the appearance of a frog, is preferably colored generally green with, perhaps, differently colored eyes. The illustrated reel 50 (FIGS. 3 and 4), which is configured to have the appearance of a duck, is preferably colored generally yellow with an orange beak and, perhaps, differently colored eyes. The illustrated reel 60 (FIG. 5), which is configured to have the appearance of a ladybug, is preferably colored generally red with black spots.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A reel housing configured to enclose a rotatable reel drum, said housing having an access panel having an exterior surface, said access panel having a closed position in which said access panel does not permit a human hand to access an interior of said housing, and an open position in which said access panel permits a human hand to access said interior of said housing, said exterior surface of said access panel having facial indicia to resemble one of an animal, a human, a human-like character, and an alien creature, said housing having an aperture sized to closely surround spoolable linear material extending through said aperture, so that the linear material can be spooled onto and unspooled from the reel drum while said housing encloses the reel drum, wherein said aperture is located within said facial indicia.

2. The reel housing of claim 1, wherein said access panel is removable from the remainder of said housing.

3. The reel housing of claim 1, wherein said access panel is hingedly attached to the remainder of said housing.

4. The reel housing of claim 1, wherein said facial indicia includes one or more of (i) a pair of eyes, (ii) a nose or beak, and (iii) a mouth.

5. The reel housing of claim 1, wherein said facial indicia are three dimensional in form.

6. The reel housing of claim 5, said facial indicia comprising elements protruding outward from said access panel.

7. The reel housing of claim 5, said facial indicia comprising indentations in said exterior surface of said access panel.

8. The reel housing of claim 1, wherein said housing encloses a rotatable reel drum.

9. The reel housing of claim 1, wherein said facial indicia resemble the appearance of an insect's face.

10. The reel housing of claim 9, wherein said facial indicia resemble the appearance of a ladybug's face.

11. The reel housing of claim 1, wherein said facial indicia resemble the appearance of an aquatic animal's face.

12. The reel housing of claim 11, wherein said facial indicia resemble the appearance of a frog's face.

13. The reel housing of claim 11, wherein said facial indicia resemble the appearance of a duck's face.

14. A reel housing comprising a housing body configured to enclose a rotatable reel drum as linear material is spooled onto or unspooled from the drum, said housing body having an aperture through which the linear material is spooled or unspooled and a removable access panel having an exterior surface, wherein removal of said access panel allows access to an interior of said housing body, said exterior surface of said access panel being decorated with three dimensional facial indicia including one or more of (i) a pair of eyes, (ii) a nose or beak, and (iii) a mouth, wherein said aperture is located within said facial indicia.

15. The reel housing of claim 14, said facial indicia comprising elements protruding outward from said access panel.

16. The reel housing of claim 14 said facial indicia comprising indentations in said exterior surface of said access panel.

17. The reel housing of claim 14, said facial indicia resembling the face of a character.

18. The reel housing of claim 14, said facial indicia resembling the face of an animal.

19. The reel housing of claim 18, wherein said facial indicia resemble one of a ladybug's face, a frog's face, and a duck's face.

20. The reel housing of claim 14, wherein said housing body encloses a rotatable reel drum.

21. A reel housing configured to enclose a rotatable reel drum, said housing comprising a housing body and a facial indicia element configured to be selectively attached and detached from said housing body, said facial indicia element having an exterior surface decorated with facial indicia to resemble one of an animal, a human, a human-like character, and an alien creature, the housing having an aperture sized to closely receive spoolable linear material extending through said aperture, wherein said aperture is located within said facial indicia.

22. The reel housing of claim 21, wherein the aperture is within said facial indicia element.

23. The reel housing of claim 21, wherein the facial indicia element comprises an access panel having an open position in which said access panel permits a human hand to access said reel drum, and a closed position in which said access panel prevents a human hand from accessing said reel drum.

24. A reel comprising a rotatable reel drum and a housing enclosing the reel drum, wherein the housing comprises a housing body and a facial indicia element configured to be selectively attached and detached from the housing body, the housing having an aperture sized to closely receive spoolable linear material extending through the aperture, the facial indicia element having an exterior surface decorated with facial indicia to resemble one of an animal, a human, a human-like character, and an alien creature, wherein said aperture is located within said facial indicia.

25. The reel of claim 24, wherein the housing is generally spherical.

26. The reel of claim 24, wherein the facial indicia element comprises an access panel having an open position in which said access panel permits a human hand to access said reel drum, and a closed position in which said access panel prevents a human hand from accessing said reel drum.

* * * * *